US006041440A

United States Patent [19]

Jackson

[11] Patent Number: 6,041,440

[45] Date of Patent: Mar. 28, 2000

[54] EAR PROTECTING DEVICE

[76] Inventor: Linnie Jackson, 10000 Hammerly, #109, Houston, Tex. 77080

[21] Appl. No.: 09/347,727

[22] Filed: Jul. 6, 1999

[51] Int. Cl.[7] ..... A61F 11/14

[52] U.S. Cl. ..... 2/209; 2/174; 128/866

[58] Field of Search ..... 2/174, 209; 128/864, 128/866

[56] References Cited

U.S. PATENT DOCUMENTS

| | | | |
|---|---|---|---|
| 2,258,929 | 10/1941 | Graves | 2/174 |
| 4,916,758 | 4/1990 | Jordan-Ross | 2/174 |
| 5,749,099 | 5/1998 | Voorhees | 2/209 |
| 5,920,912 | 7/1999 | Patchett | 2/209 |

*Primary Examiner*—Peter Nerbun
*Attorney, Agent, or Firm*—Kenneth D. Baugh

[57] ABSTRACT

An ear protecting device 10 is provided for protecting an individual's ear 12 from heat and moisture. The device 10 includes a lower support member 18 for covering areas 28 around and adjacent to the ear 12 and an upper support member 34 aligned with the lower support member for covering the ear. The upper support member 34 includes a recessed member 64 having an aperture 86 formed in a lower portion thereof. The recessed member 64 is provided for covering a recessed inside surface 58 of the ear 12 when the aperture 86 is aligned adjacent the ear canal. A diagonally descending back member 46 is coupled between an outermost portion of one side of the upper support member 34 and an innermost portion of one side of the lower support member 18 for covering a back diagonally descending member 42 of the ear 12. When the device is in place the device conforms to the shape of the ear 12 thereby covering the entire ear as well as adjacent areas 28 of the individual's head 14. As a result a protective cover 10 is formed to cover the ear 12 and predetermined areas adjacent to the ear.

10 Claims, 4 Drawing Sheets

EAR PROTECTING DEVICE

TECHNICAL FIELD

This invention relates to an ear protector and more particularly to a device to be used to protect the ear from heat and/or moisture during hair treatment operations.

Hair grooming and cleansing operations are a necessary part of life. The process may be as simple as washing an individual's hair or may become more elaborate requiring the use of chemicals and/or heat. Hair cleansing and treating operations may very often include the use of liquids such as water and other moisturizer as well as chemicals. The process may also require the use of hair drying devices which generate heat. The use of the liquids as well as the hair drying devices can very often result in some discomfort to the individual. One of the more common discomforting experiences for an individual is discomfort to the ears during these procedures. It is not unusual to receive painful burns to the ear because of the liquid chemicals used for treatment of the hair as well as because of the heat that is generated by the hair dryers used during the process. The elimination of these discomforting experiences is a necessity. Accordingly it is desirable to provide a device for preventing unwanted discomfort to the ears during the hair cleaning and treating process.

BACKGROUND

There are a number of ear protecting devices today. However these devices do not necessarily address all of the concerns necessary to protect an individual's ears during the hair cleansing and treating process. A number of attempts have been made to provide protecting devices. Such arrangements are shown in U.S. Pat. No. 4,916,758 and U.S. Pat. No. 4,308,623.

These arrangements are designed to be substantially waterproof or liquid proof. That is they are at least water or liquid resistant with respect to the ordinarily employed hair and scalp treating compositions. These arrangements do attempt to deal with the problem of keeping unwanted liquids out of the ear. Although these devices address the issue of providing a waterproof environment for the ear, they do not protect the ear from heat associated with hair dryers and some hair treating chemicals.

A device for providing a waterproof and heat sealed environment for the ear is desirable and needed.

DISCLOSURE OF THE INVENTION

A device for protecting an ear from heat and moisture is provided. The device includes a lower support member for covering areas around and adjacent to the ear and an upper support member aligned with the lower support member. A recessed member having an aperture formed in a lower portion thereof, is formed in the upper support member. The recessed member is provided for covering a recessed inside surface of the ear. A diagonally descending member is coupled between an outermost portion of one side of the upper support member and an innermost portion of one side of the lower support member for covering a back portion of the ear. A first semicircularly configured elongated member is coupled to one side portion of the upper support member for engaging and covering a first elongated semicircularly shaped outwardly protecting member of the ear. The ear protecting device is provided with a second elongated member which is coupled in the recessed member adjacent to and spaced from the first elongated member to engage and cover a first elongated ridge like member formed on the recessed inside surface of the ear adjacent to the first outwardly projecting member of the ear. Additionally a third elongated member is coupled in the recessed member adjacent to upper portions of the second elongated member. The third elongated member is provided to engage and cover a second elongated ridge like member formed on the recessed inside surface of the ear adjacent upper portions of the first elongated ridge like member. A semicircularly v-shaped elongated member is coupled to the other side of the upper support member between the second and third elongated members. This elongated member is provided to engage and cover an elongated semicircularly shaped innermost outwardly projecting member of the ear. When the device is in use the recessed member is aligned in the recessed inside surface of the ear so that the aperture formed therein is aligned with the ear canal and so that the elongated members are aligned to cover respective adjacently aligned outwardly projecting and elongated ridge like members of the ear. As a result a protective cover conforming to the shape of the ear is formed to cover the ear and predetermined areas adjacent thereto.

BEST MODE FOR CARRYING OUT THE INVENTION

Figure 1:
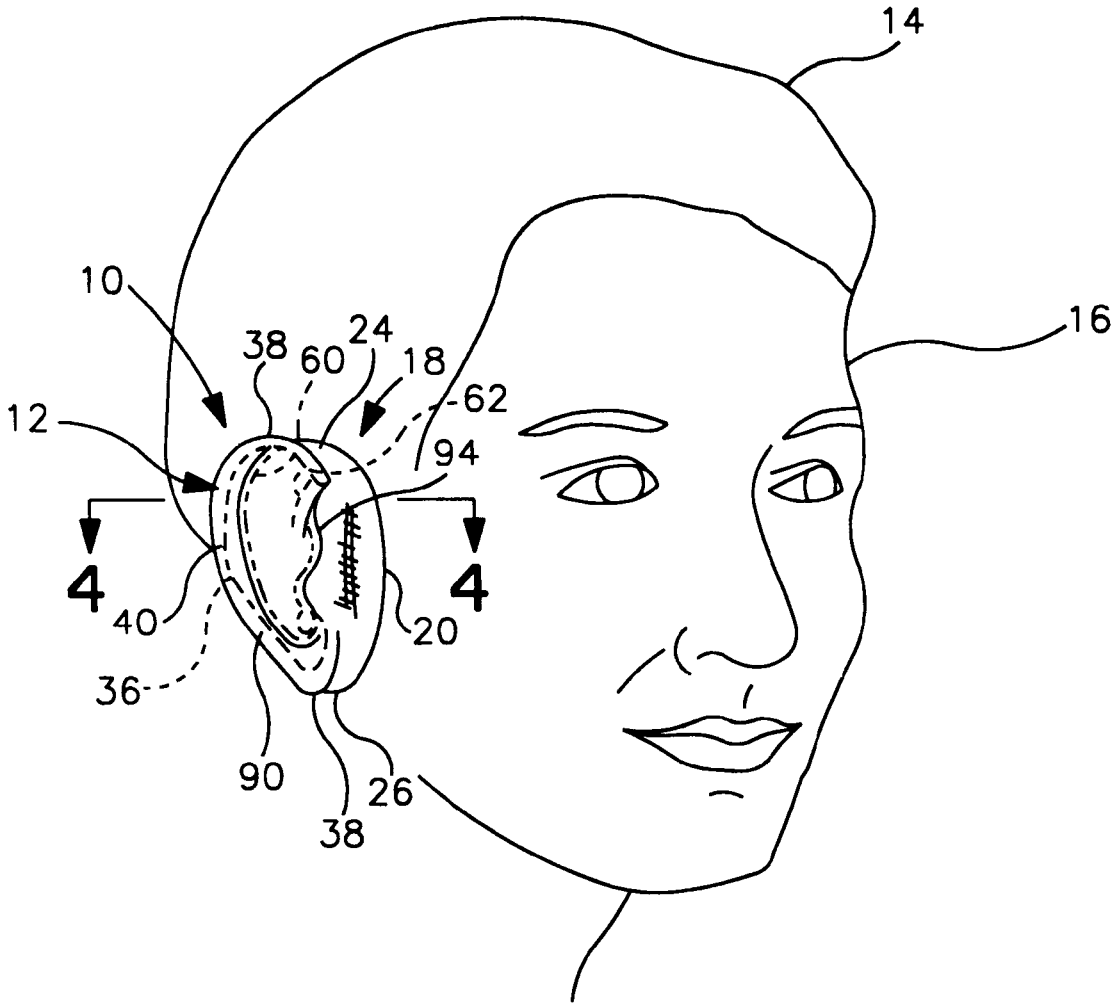
FIG. 1 is a view of an ear protecting device as worn by a user.
Figure 2:
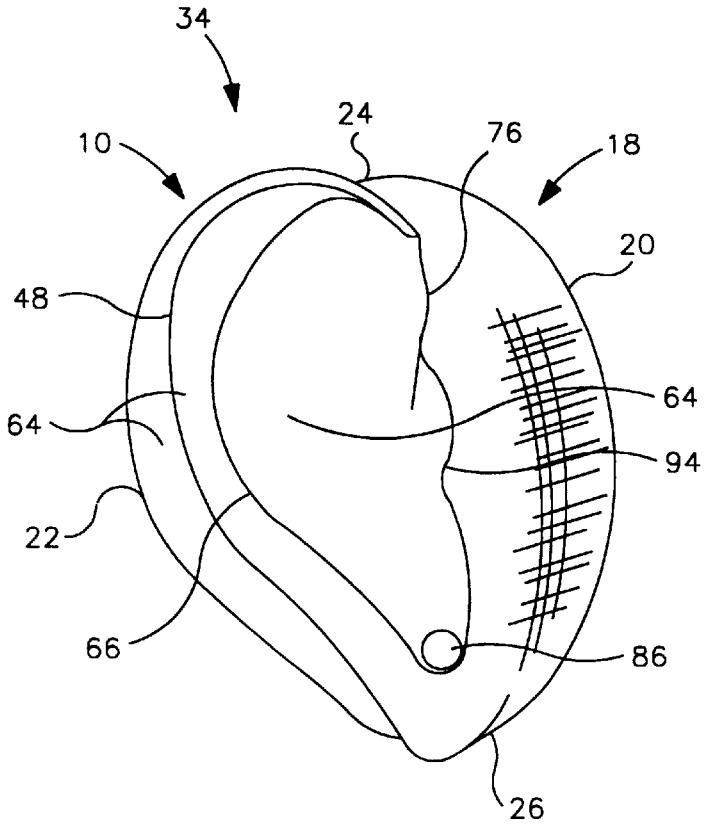
FIG. 2 is a front view of the ear protecting device.

As illustrated in FIGS. 1, 2, 3 and 4 an ear protecting device generally designated by the numeral 10 is provided for covering an ear, generally designated, by the numeral, 12 (shown in dotted lines in FIG. 1) on the head 14 of an individual 16 so that the ear is protected from heat and moisture. The ear protecting device 10 includes a lower support member, generally designated by the numeral, 18. The lower member 18 of the ear protecting device 10 is formed in a circular like configuration having laterally extending side walls 20 and 22 and upper and lower walls 24 and 26 respectively (FIG. 2). The lower support member 18 of the ear protecting device 10 is provided to cover those portions 28 (FIG. 4) of a persons head 14 which are immediately adjacent to and surround the ear 12.

The ear protecting device 10 also includes an upper support member, generally designated by the numeral, 34. The upper support member 34 is provided to cover the ear 12.

Figure 3:
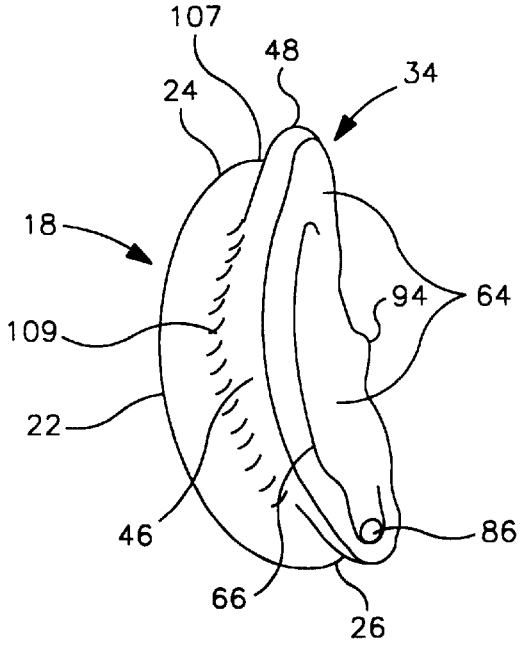
FIG. 3 is a rear perspective view of an ear protecting device in accordance with the principles of the invention.
Figure 4:
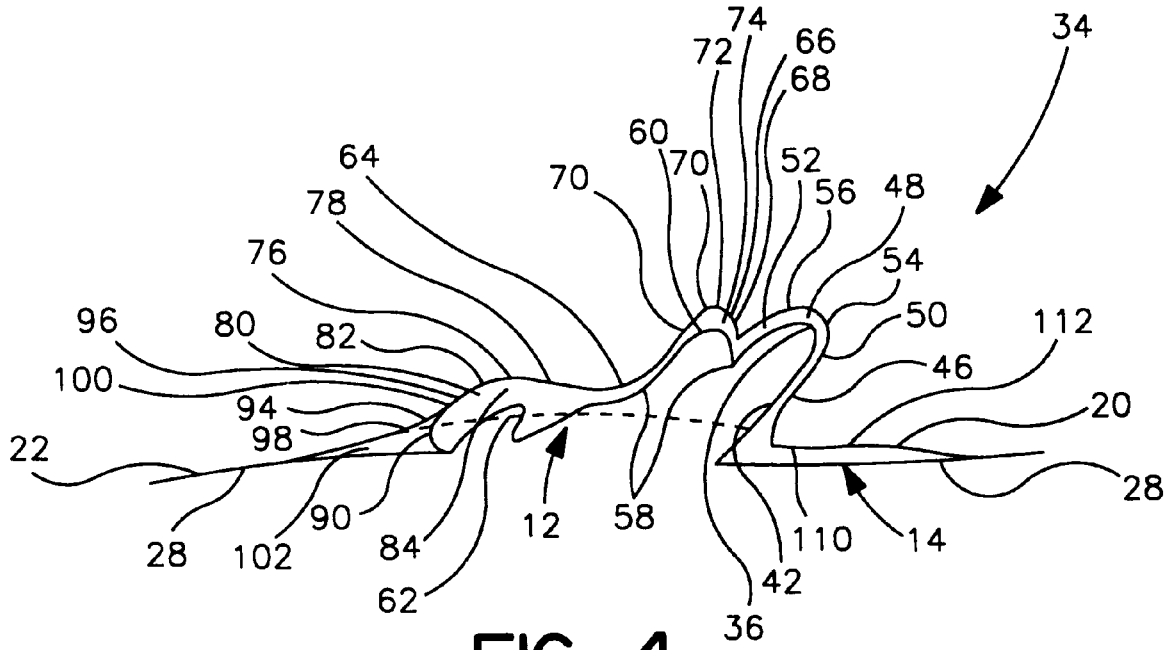
FIG. 4 is a top cross-sectional view taken along lines 4—4 of FIG. 1 of an ear protecting device in accordance with the principles of the invention.
Figure 5:
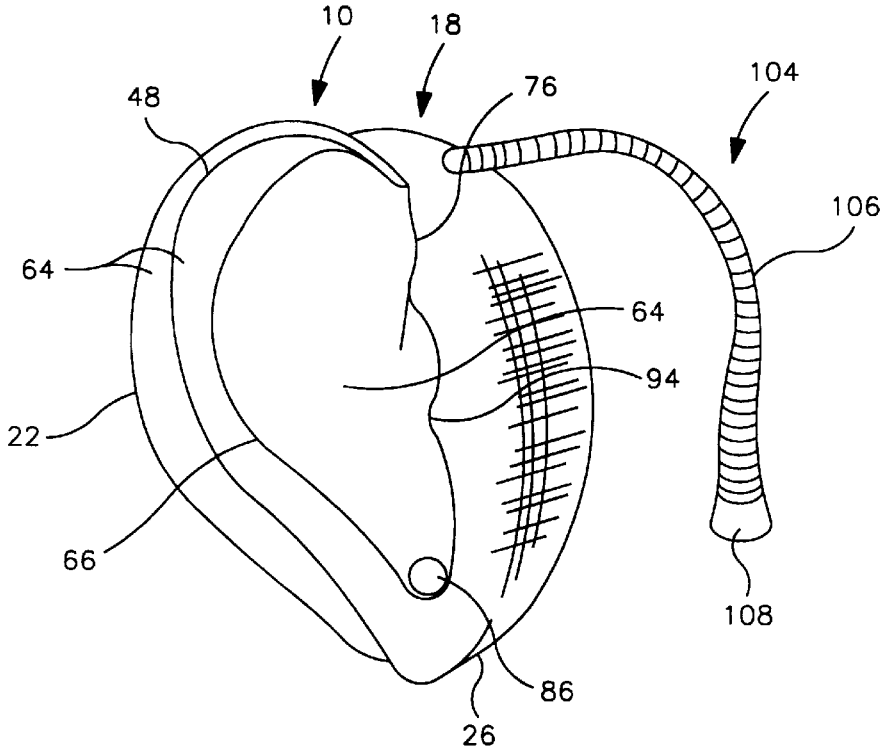
FIG. 5 is a front view of the ear protecting device including an ear plug in accordance with the principles of the invention.
Figure 6:
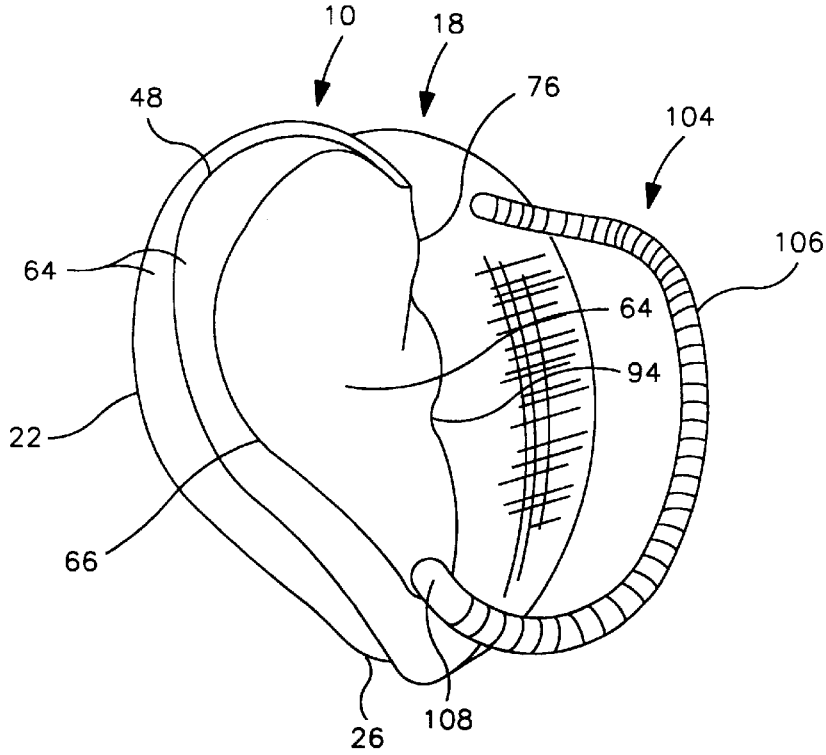
FIG. 6 is a front view of the ear protecting device including an ear plug set in place in accordance with the principles of the invention.

The ear 12 is formed with an elongated semicircularly configured outwardly projecting member 36 (FIGS. 1, 4). The member 36 which is the outermost member of the ear 12 has end portions 38 which are directly coupled to the head 14 and intermediate portions 40 which are aligned with and spaced from the head 14. The intermediate portions 40 of the ear member 36 are coupled to the head 14 by a diagonally descending back member 42. The upper support member 34 is formed with a diagonally descending back member 46 (FIG. 3) which couples the upper support member 34 to portions of the side wall 22 and upper and lower walls 26 and 26 of the lower support member 18. The back member 46 is provided to cover the back diagonally descending wall member 42 of the ear 12. The upper support member 34 is also provided with a semicircularly configured elongated channel-like member 48. The elongated channel-like member 48 is provided with a pair of spaced side wall portions 50 and 52 and an upper wall portion 54. The upper wall portion 54 is coupled between upper portions of the side walls 50 and 52 thereby forming a hollow channel 56 therebetween. The semicircularly configured elongated channel-like member 48 is provided to cover the outwardly projecting member 36 when the member 36 is aligned in the channel 56.

The ear 12 of the individual 16 also includes a recessed inside surface 58. The recessed inside surface 58 of the ear 12 includes an upstanding elongated ridge like member 60 which is aligned adjacent to portions of the outwardly projecting ear member 36. An upper elongated ridge like member 62 is aligned adjacent to upper portions of the ridge-like member 60. The inside surface 58 of the ear also includes a hearing canal (not shown) which functions in a well known manner.

The upper support member 34 is provided with a recessed surface 64 coupled to the elongated channel-like member 48 which is provided to cover the inside recessed surface 58 of the ear 12.

The recessed surface 64 is provided with a first elongated channel like member 66. The channel like member 66 is also provided with a pair of spaced side walls 68 and 70 and an upper walls 72 coupled together at upper portions of the sidewalls 68 and 70 to form a hollow channel 74 therebetween. The channel-like member 66 is provided to cover the elongated ridge like member 60 on the inside recessed surface 58 of the ear 12 when the member is aligned in the channel 74.

The recessed surface 64 of the upper support member 34 is also provided with a second elongated channel-like member 76. The member 76 includes side walls 78 and 80, an upper wall 82 and a hollow channel 84 formed between the walls. The channel 84 is provided to receive the upper elongated ridge like member 62 of the inside recessed surface 58 of the ear 12. This allows the elongated channel like member 76 to cover the ridge-like member 62.

The recessed surface 64 of the upper support member 34 also has an aperture 86 which is formed therein which is alignable adjacent the ear canal of the ear 12.

The ear 12 is also formed with a semicircularly v-shaped outwardly projecting member 90. This member 90 is coupled between the members 66 and 76 of the ear 12. The member 90 is the innermost member of the ear 12.

The upper support member 34 is provided with an inside elongated semicircularily v-shaped elongated member 94.

The elongated member 94 is provided having sidewalls 96 and 98 an upper wall 100 and a channel 102 formed between the walls. The elongated member 94 is provided to engage and cover the innermost outwardly projecting member 90 of the ear 12 when those portions of the ear are aligned inside the channel 102.

The ear protecting device 10 is also provided with an ear plug, generally designated, by the numeral, 104. The ear plug 104 includes an elongated member 106 which is coupled at one end thereof to the lower support member 18 and an aperture plug 108 coupled to the other end of the elongated member. The ear plug 104 is provided to be placed in the aperture 86 to plug the aperture so that the ear canal is protected from heat and moisture.

The ear protecting device 10 is also provided with a channel 107 (FIG. 3). The channel 107 is formed between the upper wall 24 of the lower support member 18 and upper portions of the elongated member 34. The channel 107 is provided to accommodate and hold an arm or temple portion of an individuals eye glasses (not shown) in place on the ear protecting device. This allows an individual who wears eye glasses to continue to wear them during the hair treating operation without any discomfort.

The ear protecting device 10 may also be provided with an elastic like member 109 (FIG. 3) formed between the lower support member 18 and the upper support member 34. The elastic member 109 is provided to fit on the back member 42 of the ear 12 to help hold the ear protecting device in place.

The lower support member 18 and the upper support member 34 are formed of inside and outside layers 110 and 112 respectively. The inside layer 110 of the support members 18 and 34 is the layer that is closest to the skin of the individual and maybe for example made of a flexible rubber like material which is imperious to heat. The outside layer 112 is also made of a flexible material which is heat resistant and imperious to moisture. Similarly, the ear plug 104 is formed of a flexible material which is impervious to heat and moisture.

The dimensions of the ear protecting device 10 are such that the device is made to conform to the shape of the ear 12 of the individual 16. This permits a more efficient shield and thus better protection from heat and moisture.

When it is desired to secure the ear protecting device 10 to the ear 12 the device is positioned as is illustrated in FIGS. 1 and 4. As is shown the device 10 is aligned with the ear 12 so that the aperture 86 in the upper support member 34 is aligned with the ear canal in the ear. The lower support member 18 is aligned adjacent to the ear 12 so that the semicircularily shaped elongated member 48 of the upper support member 34 is positioned over the ear member 36. Similarly, the recessed surface 64 of the upper support member 34 is positioned to cover the inside recessed surface 58 of the ear 12 and held in place therein by the upstanding ridge like members 60 and 62 being positioned in the channels 74 and 84 respectively of the elongated members 76 and 84. The elongated member 94 is aligned with the ear so that the innermost outwardly projecting ear member 90 is aligned in the channel 102 of the elongated member.

When the device 10 is positioned in this manner the entire ear 12, including the inside recessed surface 58 and the back member 42 of the ear, is covered as well as adjacent portions 28 of the individual's 16 head 14.

The plug 104 can then be inserted in the aperture 86 as when desired to cover the ear canal of the ear 12. As a result the ear 12 and portions of the individual's 16 head 14 are protected from heat and moisture thereby facilitating a more comfortable hair treatment experience.

It should be understood that various changes and modifications can be made without departing from the spirit of the invention as defined in the following claims.

What is claimed:

1. A device for protecting an ear from heat and moisture including:

a lower support member for covering areas around and adjacent to the ear;

an upper support member aligned with the lower support member;

a recessed member formed in the upper support member, having an aperture formed in a lower portion thereof, for covering a recessed inside surface of the ear;

a diagonally descending back member coupled between an outermost portion of one side of the upper support member and an innermost portion of one side of the lower support member for covering a back portion of the ear;

a first semicircularly configured elongated member coupled to outermost portions of the upper support member for engaging and covering first semicircularly configured outwardly protecting portions of the ear;

a second elongated member coupled in the recessed member adjacent to and spaced from the first elongated member for engaging and covering a first elongated ridge like member formed on the recessed inside surface of the ear which is adjacent to the first outwardly projecting portions of the ear;

a third elongated member coupled in the recessed member adjacent to upper portions of the second elongated member for engaging and covering a second elongated ridge like member formed on the recessed inside surface of the ear adjacent upper portions of the first elongated ridge like member; and a semicircularly v-shaped elongated member coupled to innermost portions of the upper support member between the second and third elongated members for engaging and covering a semicircularly v-shape innermost outwardly projecting member of the ear so that when the aperture in the recessed member is aligned with the ear canal in the ear and the elongated members are moved into alignment with respective adjacent outwardly projecting and elongated ridge like members of the ear a protective cover conforming to the shape of the ear is formed to cover the ear and predetermined areas adjacent to the ear.

2. A device as defined in claim 1 wherein the lower support member includes:

first laterally extending portions which are aligned to engage and cover predetermined areas adjacent to and behind the back of the ear;

second laterally extending portions which are aligned to engage and cover predetermined areas adjacent to upper portions of the ear;

predetermined areas adjacent to lower portions of the ear; and fourth laterally extending portions which are aligned to engage and cover predetermined areas adjacent to the front of the ear.

3. A device as defined in claim 2 wherein each elongated member includes;

a first side wall;

a second side wall spaced from the first side wall; and an upper wall coupled between upper portions of the first and second side walls so that a hollow channel is formed therebetween.

4. A device as defined in claim 3 wherein the lower support member and the upper support member each further include:

an inside layer which is impervious to heat; and an outside layer coupled to the inside layer which is heat resistant and impervious to moisture so that the ear can be protected from moisture and heat.

5. A device as defined in claim 4 further including a means for covering the aperture in the recessed member.

6. A device as defined in claim 5 wherein the aperture covering means includes:

a first portion coupled to the lower support member; and a second portion coupled to the first portion for selectively engaging the aperture in the upper support member.

7. A device as defined in claim 6 wherein the aperture covering means includes an elongated member having one end thereof coupled to the base member and the other end thereof for engaging the aperture.

8. A device as defined in claim 7 wherein the aperture covering means is impervious to moisture and heat.

9. A device as defined in claim 8 further including a channel member formed between the lower support member and the upper support member to hold an arm of an individual's eye glasses in a predetermined position.

10. A device as defined in claim 9 further including an elastic member formed to fit on the back member and help hold the ear protecting device into a predetermined position.

* * * * *